US005525185A

United States Patent [19]

Holbrook et al.

[11] Patent Number: 5,525,185

[45] Date of Patent: Jun. 11, 1996

[54] BELT CARTRIDGE FLAP MOISTENING APPARATUS

[75] Inventors: Russell W. Holbrook, Southbury; Thomas M. Lyga, Torrington, both of Conn.

[73] Assignee: Pitney Bowes Inc., Stamford, Conn.

[21] Appl. No.: 362,023

[22] Filed: Dec. 22, 1994

[51] Int. Cl.[6] ..... B43M 5/04

[52] U.S. Cl. ..... 156/441.5; 156/442.1; 156/442.2; 156/578; 118/257; 118/259; 118/263; 401/208; 401/118; 401/119

[58] Field of Search ..... 156/441.5, 442.1, 156/442.2, 578; 118/257, 32, 259, 263, 266; 401/208, 118, 119

[56] References Cited

U.S. PATENT DOCUMENTS

| | | | |
|---|---|---|---|
| 339,529 | 4/1886 | Cranston | 401/208 |
| 1,498,438 | 6/1924 | Dorn | 156/442.1 |
| 1,730,795 | 10/1929 | Uttz | 118/257 X |
| 2,323,004 | 6/1943 | Baylor | 118/257 X |
| 3,944,455 | 3/1976 | French | 156/556 X |
| 3,948,216 | 4/1976 | Reid et al. | 118/257 |
| 3,981,270 | 9/1976 | Bogdanski | 118/257 |
| 4,530,284 | 7/1985 | Fischer | 118/257 X |
| 4,576,311 | 3/1986 | Horton et al. | 156/584 X |
| 4,773,962 | 9/1988 | Garrigue et al. | 156/441.5 |
| 4,903,633 | 2/1990 | Nobile et al. | 118/268 |
| 4,948,453 | 8/1990 | Nobile et al. | 156/441.5 |
| 4,978,114 | 12/1990 | Holbrook . | |
| 5,006,194 | 4/1991 | Schmaling | 156/442.1 |
| 5,022,953 | 6/1991 | Fassman et al. | 156/441.5 |
| 5,153,659 | 10/1992 | Maiefski et al. . | |
| 5,277,509 | 1/1994 | Danehy | 401/208 |

*Primary Examiner*—James Engel
*Assistant Examiner*—Steven J. Helmer
*Attorney, Agent, or Firm*—Lawrence E. Sklar; Melvin J. Scolnick

[57] ABSTRACT

A moistening apparatus for a mail handling machine including a container for storing liquid which is mounted within the mail handling machine and a cartridge assembly removably mounted to the container. The cartridge assembly has a housing and a belt movably mounted within the housing such that at times when liquid is in the container the belt is capable of movement through the liquid to a position where the belt is presented for contact with mailpieces being processed through the mail handling machine.

8 Claims, 4 Drawing Sheets

BELT CARTRIDGE FLAP MOISTENING APPARATUS

BACKGROUND

This invention relates to an apparatus for moistening the gummed closure flaps of envelopes, and more particularly to a moistening apparatus and associated liquid reservoir assembly for use in a mail handling machine.

Mail handling machines, such as that described in U.S. Pat. No. 4,935,078, process mixed mailpieces (varying size) in a high speed manner. These known mail handling machines typically include a front end feeder, a singulator, a moistener, a sealer, and a printing device. The front end feeder shingles the incoming mailpieces (such as envelopes) and the singulator grabs the bottom envelope from the shingled stack of envelopes for subsequent processing downstream. Upon passing by the singulator, the envelope is successively fed past the moistener where its flap portion is moistened and is then passed through a sealer where the flap is sealed prior to the printing of, for example, postage values thereon by the printing device (postage meter). Moreover, the mail handling machine may further include a scale for weighing the mailpieces and a tape mechanism for the printing of indicia on a tape.

There are a number of conventional moistening devices that are used in mail handling machines for moistening the gummed portions of envelope flaps passing thereby. These moistening devices either apply liquid to the gummed portion by direct contact therewith or spray liquid onto the gummed portion without physical contact between the envelope flap and the moistening device. Each of the contact and non-contact moistening devices have certain operational limitations. For example, contact moisteners such as wicks or pads typically receive liquid from a liquid reservoir via capillary action and transfer that liquid onto the flap gummed portion by direct contact therewith. The gummed portion is activated to become sticky for subsequent sealing due to the application of the liquid and the rubbing action between the flap and pad. However, it is inevitable in such moistening devices that the pad or wick will have a certain amount of the gummed portion transferred onto its surface. The build up of the gummy material on the pad, over time, eventually impacts the ability of the pad to apply the appropriate amount of liquid onto the envelope flap resulting in insufficient or spotty activation of the gummed portion of the envelope; which in turn leads to an unsealed or improperly sealed envelope.

U.S. Pat. No. 4,873,941 describes a non-contact moistening device which overcomes the problems associated with the contact systems set forth above by spraying liquid onto the gummed portion of the envelope flap. However, this device requires a complicated and expensive control mechanism to ensure that only the gummed portion receives the sprayed liquid to prevent damage to the envelope contents due to inadvertent contact with the sprayed liquid. Furthermore, since there is no contact between the spraying device and the gummed portion, the activation of the gummed portion is not assisted by any rubbing action, and therefore increased amounts of liquid (as compared to contact systems) need to be sprayed onto the gummed portion in order to ensure its activation. The excess sprayed liquid presents a problem in that it runs off the envelope flap and must somehow be collected and recirculated within the mail handling machine. Additionally, the excess liquid further exacerbates the problem of preventing damage to the envelope contents.

U.S. Pat. No. 3,948,216 issued to Reid et al. on Apr. 6, 1976 and incorporated herein by reference, to a large extent overcomes the above-mentioned problems of the prior art devices by utilizing a moveable endless belt in communication with a liquid reservoir to moisten the gummed portion of envelope flaps. The endless belt is continuously rotated through the liquid reservoir such that a portion of its surface is always presented for contact with the passing envelope flap. Since the endless belt is constantly moved through the liquid reservoir, the tendency for it to become gummed up is greatly reduced. Moreover, since the endless belt presents a much greater surface area for use in transferring liquid to the gummed portion, even if some of the gummed portion is transferred to the endless belt, a build up of the gummy substance on the belt which would require replacement of the belt does not occur as frequently as in the aforementioned contact devices. However, in the event that the endless belt requires replacement for any number of reasons, its replacement is not easily accomplished. That is, since the support structure for the endless belt is connected to the bottom of the mailing machine deck, it is not readily accessible. Therefore, a serviceman is often required to replace the belt which results in service costs in addition to the cost of the belt, as well as increased downtime of the mail handling machine.

Thus, what is needed is a moistening device which overcomes the problems of the prior art devices and which is very accessible such that replacement thereof can be easily accomplished by the owner or operator of the mail handling machine.

SUMMARY OF THE INVENTION

It is an object of the invention to provide a user replaceable moistening cartridge for a mailing machine.

It is yet another object of the invention to provide a moistening device which is easily replaceable in order to reduce 1) the need for service calls in connection with the moistening device, 2) the costs associated with replacement of the moistening device, and 3) the downtime attributable to the moistening device.

The above objects are met by providing a moistening apparatus for a mail handling machine. The apparatus includes a container for storing liquid which is mounted within the mail handling machine and a cartridge assembly removably mounted to the container. The cartridge assembly has a housing and a belt movably mounted within the housing such that at times when liquid is in the container the belt is capable of movement through the liquid to a position where the belt is presented for contact with mailpieces being processed through the mail handling machine.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
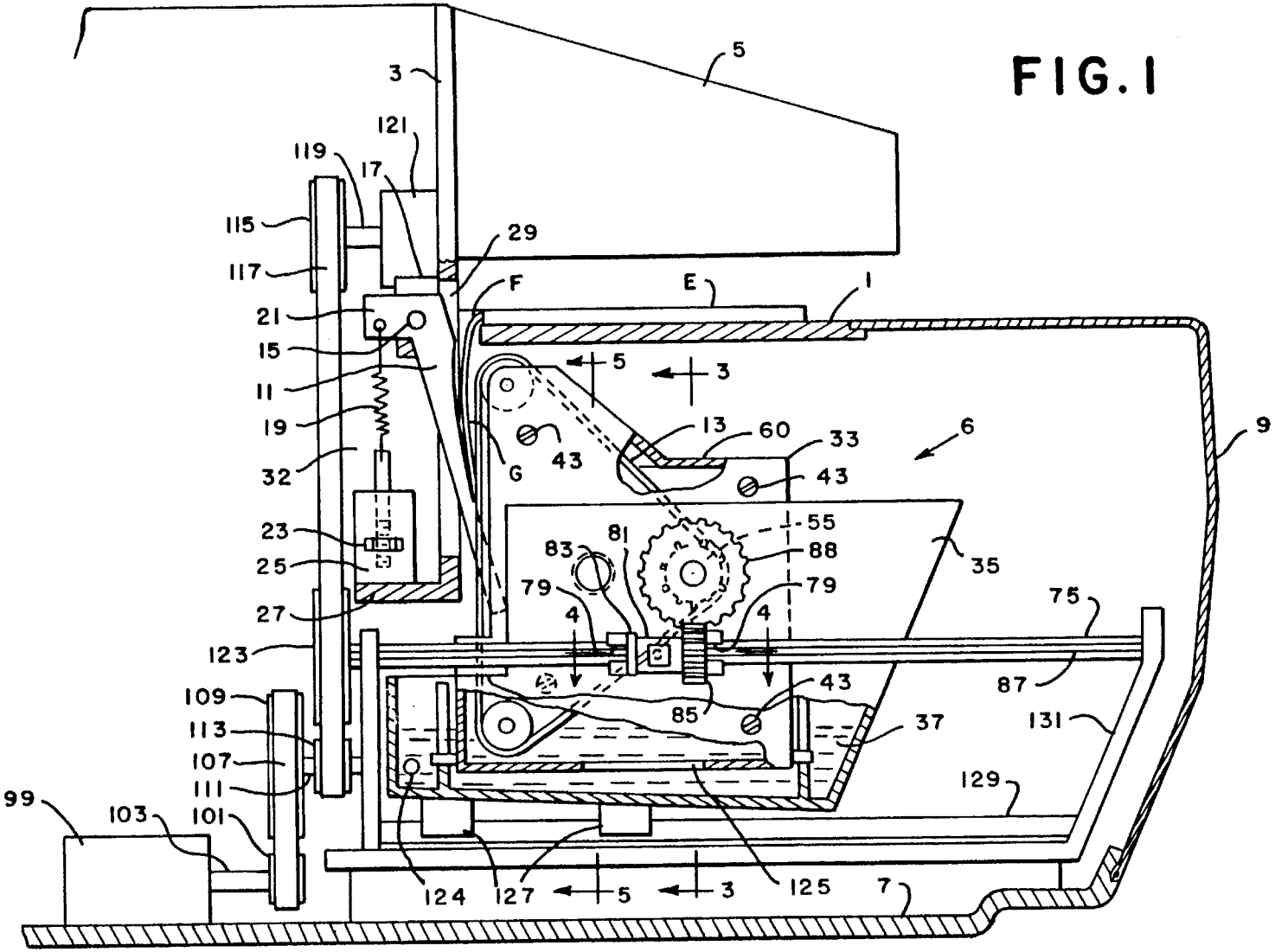
FIG. 1 is a cross-section of a mail handling machine (with portions cut away) looking downstream and showing the inventive moistening device in an operative position.
Figure 5:
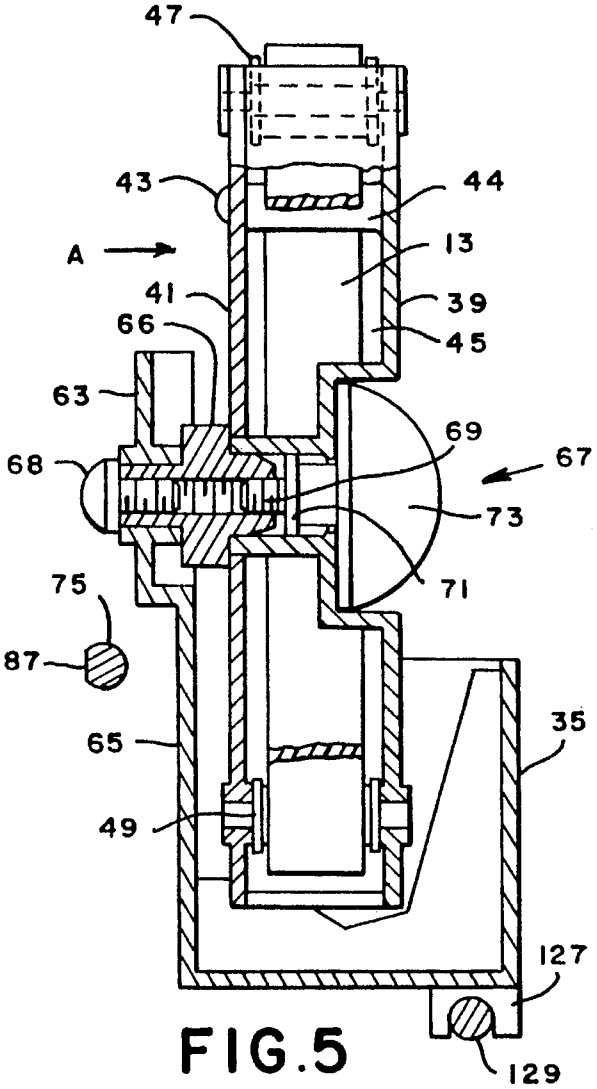
FIG. 5 is a cross-section taken along line 5—5 of FIG. 1.
Figure 3:
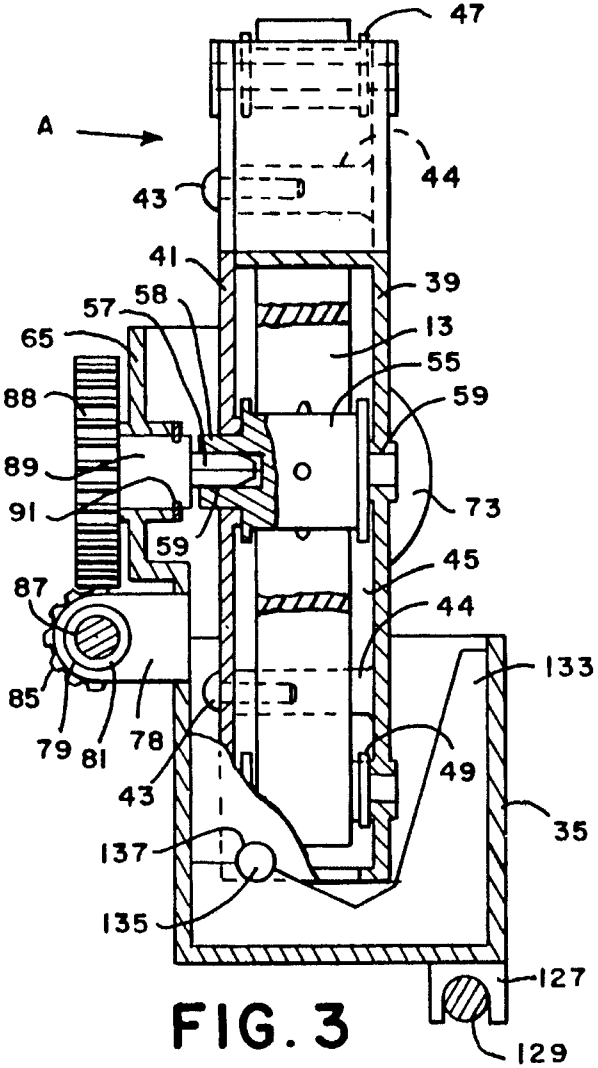
FIG. 3 is a cross-section taken along line 3—3 of FIG. 1.
Figure 6:
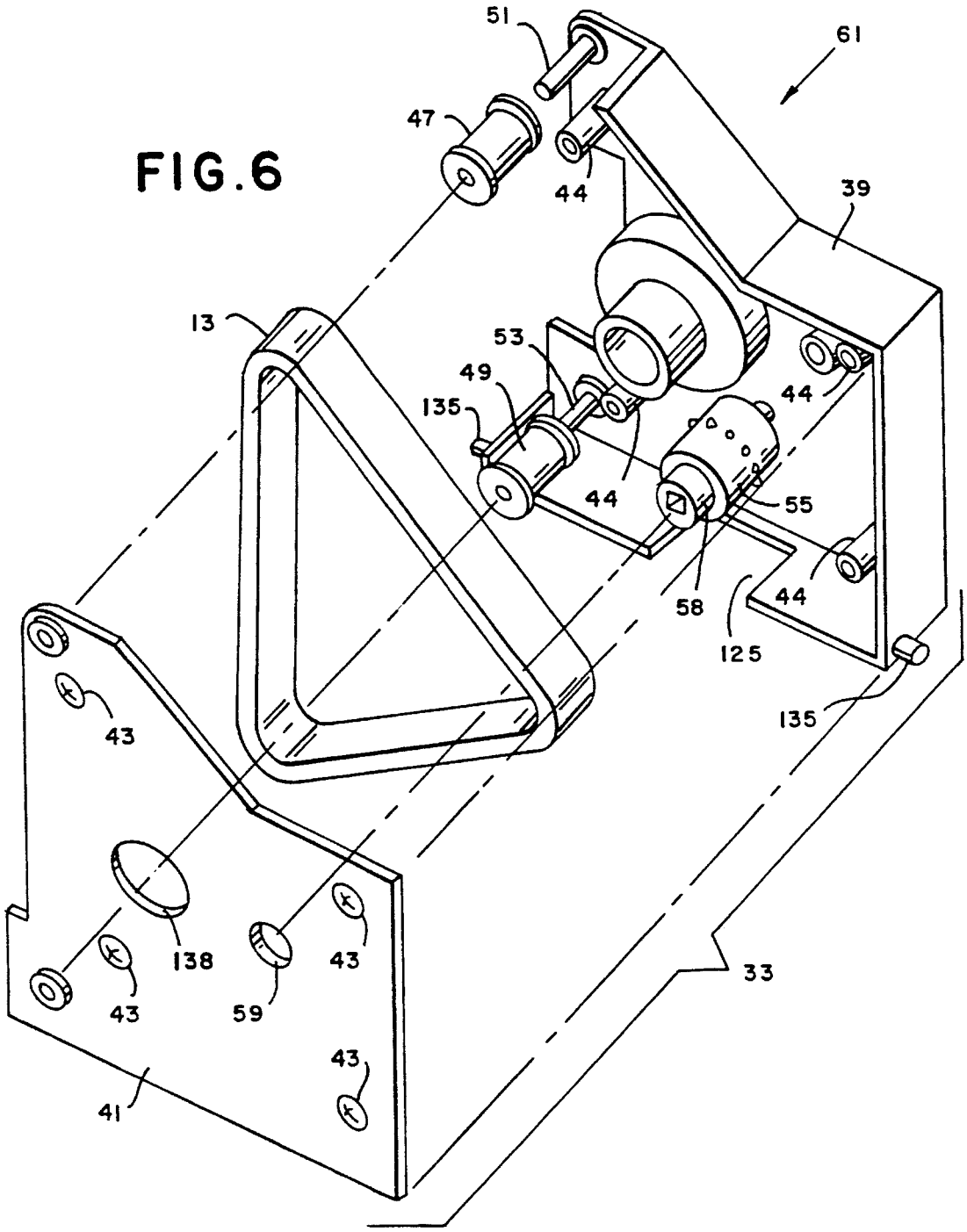
FIG. 6 is an exploded perspective view of the belt cartridge assembly.

FIG. 1 shows the inventive moistening apparatus which can be used with most types of postage meter mailing machines as well as other types of mail handling and processing apparatus. For clarity of illustration, the only portions of the mail handling machine being shown other than the inventive moistening device are a deck 1 over which an envelope E passes, a rear registration wall 3 against which the edge of the envelope is registered, a postage meter 5 located downstream of the moistening device, a bottom wall 7, and a front cover member 9. Generally, envelopes such as the envelope E are transported through the mail handling machine in the direction indicated by the arrow A in FIGS. 3 and 5 so that the envelope travels in succession from a front end feeder (not shown), past a singulator(not shown), past the moistening device, and to the postage meter 5. While the front end feeder, and singulator are not shown, they are well known in the art.

FIG. 1 shows the moistening device 6 in its operative position with the flap F of envelope E passing between a curved finger 11 and a moving endless belt 13. Finger 11 is pivotally mounted via a spindle 15 to a projecting portion 17 of registration wall 3. Spring 19 is connected between a cantilevered portion 21 of finger 11 and a thumb screw 23 disposed in a housing 25 connected to a cantilevered portion 27 of registration wall 3. The force of spring 19 on cantilevered portion 21 forces finger 11 to rotate in a counterclockwise direction about spindle 15 such that curved finger 11 passes through an opening 29 in registration wall 3 and into contact with flap F. Due to the biasing force of spring 19, finger 11 forces flap F against belt 13. As shown in the preferred embodiment, finger 11 is disposed immediately adjacent to and downstream of the downstream edge of belt 13. Thus, due to the curved surface 31 of finger 11 and its position relative to belt 13, the bottom edge of flap F is contacted by finger 11 forcing the gummed portion G of flap F into contact with belt 13. However, since the finger 11 only contacts the lower edge of flap F, it causes an upper portion of flap F to bow out and away from belt 13 (as shown in FIG. 1) such that only the gummed portion G contacts belt 13. This ensures that only the gummed portion receives liquid from belt 13 and not other portions of the flap which ultimately contact the contents of envelope E. Further details of a particular finger design and its relationship to a moistening belt are set forth in detail in the previously referred to U.S. Pat. No. 3,948,216.

Endless belt 13 may be fabricated of any suitable material capable of picking up and transferring liquid. Synthetic napped materials, such as those identified under the tradenames Dynel and Nylon, of the type used in paint rollers have been found to be satisfactory. Moreover, since the transfer of liquid from endless belt 13 to gummed portion G is dependent upon the material used for the endless belt 13 and the pressure applied by finger 11 on flap F, it is desirable to be able to adjust the pressure being applied by finger 11 on flap F. This is accomplished in the inventive apparatus through the use of thumbscrew 23. As thumbscrew 23 is rotated such that its shaft 32 moves into housing 25, spring 19 is further extended increasing the biasing force associated therewith and correspondingly the pressure exerted by finger 11 on flap F. Thus, the amount of liquid transferred to the gummed portion G can be regulated by adjustment of thumbscrew 23. Moreover, while a manually adjusted thumbscrew has been shown in the preferred embodiment, other automated control devices can be utilized to adjust the pressure applied by finger 11 to flap F and the instant invention is meant to encompass all such devices.

Referring to FIGS. 1–6, endless belt 13 is disposed within a cartridge housing 33 removably disposed within a liquid container 35 having liquid 37 therein. Cartridge housing 33 includes first and second housing portions 39, 41 which are connected to each other via a plurality of screws 43 and corresponding threaded spacers 44. When joined together, the first and second housing portions 39, 41 form a space 45 therebetween in which the endless belt 13 is mounted for rotation. Cartridge housing 33 is completely enclosed except for one side thereof which is open to expose belt 13. Freely turning support pulleys 47,49 are also disposed within space 45 and are supported for free rotation on respective spindles 51,53. Drive pulley 55 is also mounted within space 45 and is coupled to a square shaft 57 of a drive mechanism (described in more detail hereinafter) by insertion of the square shaft 57 into a correspondingly shaped opening in a hub portion 58 of drive pulley 55. When drive pulley 55 is driven via shaft 57, it rotates within bearing surfaces 59 associated with each housing portion 39, 41. As shown clearly in FIGS. 1 and 6, belt 13 is placed around support pulleys 47, 49 and drive pulley 55 and is forced to move in a counterclockwise direction due to the rotation of drive pulley 55. Moreover, in order to ensure the uniform distribution of liquid across the entire width of the endless belt 13, a doctor blade 60 is conventionally mounted to cartridge housing 33 to contact endless belt 13.

As is clear to one possessing ordinary skill in the art, cartridge housing 33, screws 43, spacers 44, support pulleys 47,49, drive pulley 55, spindles 51,53, and endless belt 13, form a unitary belt cartridge assembly 61 which is a self-contained unit that is easily removable from within the mail handling machine and the liquid container 35. That is, cartridge assembly 61 is connected to a cantilevered portion 63 of a sidewall 65 of liquid container 35 via a bolt assembly 67 having a threaded shaft portion 69 which is threaded into corresponding threads in a spacer 66. Spacer 66 is in turn connected to cantilevered portion 63 via a screw 68. Moreover, bolt assembly 67 further includes a collar portion 71 which sits between adjacent surfaces of first housing portion 39 to eliminate any free play in bolt assembly 67 and to act as a pilot in guiding shaft 69 into alignment with the threads in spacer 66. A handle portion 73 of bolt assembly 67 is also provided to ensure that tightening and loosening of bolt assembly 67 is easily accomplished by hand. In order to remove cartridge assembly 61 from container 35, all that needs to be done is to unscrew the bolt assembly 67 from spacer 66 and then pull the entire cartridge assembly 61 to the right in FIGS. 3 and 5 until it clears the spacer 66 and drive pulley 55 is moved off shaft 57. Then, the cartridge assembly 61 can be lifted out of the liquid container 35. A replacement cartridge assembly can easily be inserted simply by reversing the steps set forth above in connection with the removal of the cartridge assembly 61.

Figure 2:
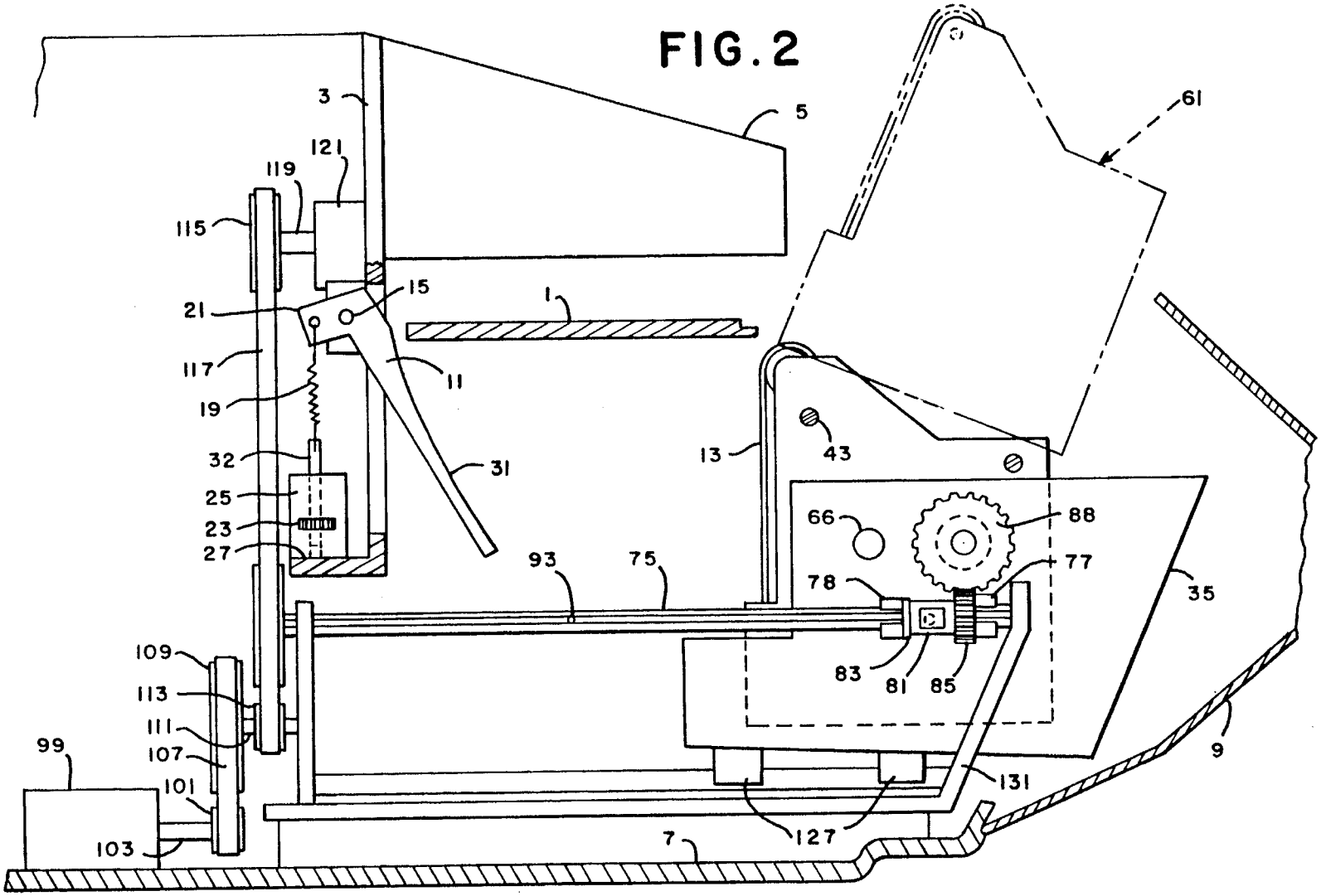
FIG. 2 is a cross-section of a mail handling machine looking downstream and showing the inventive moistening device in its retracted position to allow easy servicing thereof.
Figure 4:
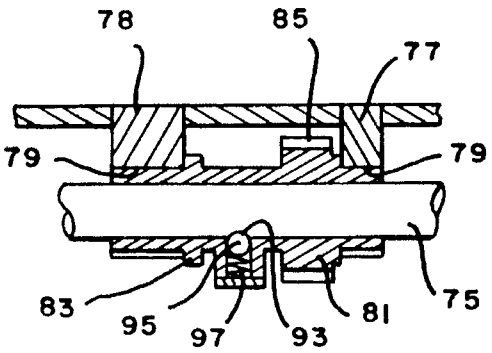
FIG. 4 is a cross-section taken along line 4—4 of FIG. 1.

In order to make the removal of the cartridge assembly 61 even easier, the cartridge assembly 61 and liquid container 35, when coupled together via the bolt assembly 67 and spacer 66, slide as a unit along drive shaft 75 as best seen in FIGS. 1, 2 and 4. A pair of collars 77, 78 extend from sidewall 65 of container 35 and each have an opening 79 to resiliently receive a sleeve 81 therein. Sleeve 81 is dimensioned to be contained in collars 77, 78 so as not to be able to be removed through openings 79 without a force being applied thereto, but is free to rotate within collars 77, 78. Sleeve 81 includes an annular rim 83 and a first gear 85 which are respectively disposed adjacent collars 78, 77 thereby containing sleeve 81 between collars 78, 77. While FIG. 1 shows first gear 85 as being formed as part of sleeve 81, it can easily be a separate component connected to sleeve 81 in a conventional manner. Drive shaft 75 is configured as a "D" shaped shaft having a flat portion 87. Drive shaft 75 passes through sleeve 81 and is dimensioned such that sleeve 81 is free to slide thereon between the positions of FIGS. 1 and 2, but is forced to rotate with drive shaft 75 due to flat part 87. When drive shaft 75 rotates, first gear 85 also rotates therewith. First gear 85 intermeshes with a second gear 88 which in turn is connected with shaft 57 via hub 89. Thus, when drive shaft 75 is forced into rotation, drive pulley 55 is forced to rotate via the first and second gears 85, 88 and the shaft 57. However, if the drive shaft 75 is not being driven, the cartridge assembly 61 and liquid container 35 can be slid as a single unit along drive shaft 75 to the position shown in FIG. 2.

Hub 89 has an o-ring 91 retained in a corresponding slot such that second gear 88 is retained in place against wall 65. As shown in FIG. 2, cover member 9 is pivotally mounted to bottom wall 7 such that when it is time to service the belt cartridge, cover member 9 can be pivoted out of the way to allow the movement of the cartridge assembly 61 and liquid container 35 to the position of FIG. 2. As is readily apparent, when the moistening structure is in the FIG. 2 position it is free from obstruction by the deck 1 allowing for the easy removal of the cartridge assembly 61 in the manner previously set forth. The dotted form of the cartridge assembly 61 in FIG. 2 shows it being removed from the mail handling machine.

Once a new cartridge assembly has been installed, cartridge assembly 61 and container 35 can be slid along drive shaft 75 into the operating position of FIG. 1. However, in order to insure that the unit is properly positioned (see FIG. 4), the drive shaft 75 can have a detent 93 therein which receives a ball 95 biased by a spring 97. The ball 95 and spring 97 are contained within sleeve 81. When the unit is properly positioned, ball 95 will click into the detent 93 such that the user will know that proper positioning has been achieved. Moreover, as is known in the art, a lockout feature can be incorporated to sense when the unit is properly positioned such that if proper positioning is not achieved the mail handling machine will not operate.

The drive mechanism for the cartridge assembly 61 includes motor 99 which is mounted to bottom wall 7. A first pulley 101 is connected to shaft 103 of motor 99 and is in communication with a belt 107 connected to a second pulley 109. Second pulley 109 has a common shaft 111 with a third pulley 113. Third pulley 113 communicates with a fourth pulley 115 via a belt 117. Fourth pulley 115 has a shaft 119 which through a coupling device 121, can be connected to pulleys (not shown) of a singulator (not shown). Belt 117 also travels around a fifth pulley 123 disposed on drive shaft 75. It is through this pulley drive system that the motor 99 drives belt 13 as well as the singulator and other mail handling machine components not discussed. Of course, while a representative drive train is shown, other direct and indirect drive trains can be used in lieu thereof.

Liquid is supplied to container 35 via a conventional supply system such that the liquid enters a port 124 in container 35 via a flexible line (not shown). Moreover, an opening 125 exists in the bottom of cartridge assembly 61 permitting liquid from container 35 to enter into cartridge assembly 61 to wet endless belt 13. Additionally, container 35 has feet 127 that ride on a guide rod 129 to provide stability to the container 35 during its travel. Guide rod 129 is fixedly mounted in a support structure 131 which extends from bottom wall 7, while drive shaft 75 is mounted in support structure 131 to be rotatable therein.

Container 35 also includes a pair of webs 133 (only one shown) which provide structural support to container 35 and help guide cartridge assembly 61 into its operating position. That is, first and second projections 135 at opposite ends of cartridge assembly 61 enter corresponding cut-outs 137 in web 133. At this point in time, cartridge assembly 61 can be easily rotated about stubs 135 until spacer 66 projects through a corresponding opening 138 in housing part 41 and shaft 57 enters into drive pulley 55.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A moistening apparatus for a mail handling machine, the apparatus comprising:

a container for storing liquid, the container mounted within the mail handling machine;

a replaceable cartridge assembly removably firmly secured to the container, the cartridge assembly having a housing and a belt movably disposed within the housing such that at times when liquid is in the container the belt is capable of movement through the liquid to a position where the belt is presented for contact with mailpieces being processed through the mail handling machine; and means movably mounting the container within the mail handling machine to be positionable together with the cartridge assembly removably firmly secured thereto between first and second positions, said moveable mounting means including a drive shaft mounted for rotation within the mail handling machine and a sleeve connected to the container and slidably mounted on the drive shaft.

2. A moistening apparatus as recited in claim 1, wherein the moveable mounting means further comprises first and second collars extending from the container each of which resiliently receives the sleeve therein.

3. A moistening apparatus as recited in claim 2, wherein the drive shaft is D-shaped such that at times when the drive shaft is not in rotation the sleeve is slidable thereon and at times when the drive shaft is in rotation the sleeve is forced to rotate therewith.

4. A moistening apparatus as recited in claim 3, further comprising a first gear connected to the sleeve to move therewith and a second gear rotatably mounted within a wall of the container in meshing engagement with the first gear, and wherein the second gear has a gear shaft extending therefrom, the cartridge assembly housing has a drive pulley rotatably mounted therein around which the belt is mounted, and the gear shaft is received in the drive pulley such that the drive shaft, the sleeve, the first and second gears, the gear shaft and the drive pulley form a drive train for driving the belt into rotation at times when the drive shaft is in rotation.

5. A moistening apparatus as recited in claim 4, wherein the sleeve further includes an annular rim and the annular rim and the first gear are each disposed between the first and second collars retaining the sleeve in position between the first and second collars.

6. A moistening apparatus as recited in claim 5, further comprising means for driving the drive shaft into rotation.

7. A moistening apparatus as recited in claim 6, wherein the cartridge assembly housing has first and second projections extending therefrom, the container includes first and second webs including respective first and second cut-outs respectively corresponding to a shape of the first and second projections, and the first and second projections are disposed respectively in the first and second cut-outs providing stability and guidance to the cartridge assembly when being mounted to the container.

8. A moistening apparatus comprising:

a container for storing liquid;

a cartridge assembly removably mounted to the container, the cartridge assembly including a belt mounted for movement therein such that at times when liquid is in the container the belt is moveable through the liquid; and means for coupling the container to a drive train such that at times when the drive train is operative the belt is forced into movement via the drive train and at times when the drive train is inoperative the container is free to move via the coupling means along at least a portion of the drive train.

* * * * *